US007145537B2

(12) United States Patent
Chen

(10) Patent No.: US 7,145,537 B2
(45) Date of Patent: Dec. 5, 2006

(54) DRIVING DEVICE AND ITS DRIVING METHOD OF LIQUID CRYSTAL DISPLAY

(75) Inventor: Li-Yi Chen, Nantou (TW)

(73) Assignee: Chi Mei Optoelectronics Corporation, Tainan County (TW)

( * ) Notice: Subject to any disclaimer, the term of this patent is extended or adjusted under 35 U.S.C. 154(b) by 412 days.

(21) Appl. No.: 10/401,461

(22) Filed: Mar. 28, 2003

(65) Prior Publication Data

US 2003/0184570 A1 Oct. 2, 2003

(30) Foreign Application Priority Data

Mar. 29, 2002 (TW) ..... 91106414 A

(51) Int. Cl.
*G09G 3/30* (2006.01)

(52) U.S. Cl. ..... 345/89

(58) Field of Classification Search ..... 345/89, 345/690, 99, 100

See application file for complete search history.

(56) References Cited

U.S. PATENT DOCUMENTS 5,495,265 A 2/1996 Hartman et al. ..... 345/87
5,528,257 A * 6/1996 Okumura et al. ..... 345/99
6,535,224 B1 * 3/2003 Kuriyama et al. ..... 345/690

FOREIGN PATENT DOCUMENTS

TW 382691 2/2000

* cited by examiner

*Primary Examiner*—Richard Hjerpe
*Assistant Examiner*—Kevin M. Nguyen
(74) *Attorney, Agent, or Firm*—Ladas & Parry

(57) ABSTRACT

A driving device for driving pixels of a display from a first gray level to a second gray level. The first memory stores a first voltage data making the pixel display the first gray level. The second memory stores a driving voltage table recording dynamic driving voltages corresponding to predetermined gray level switching, respectively. The controller uses the dynamic driving voltage to drive the pixel. The dynamic driving voltage is selected from the driving voltage table according to the first voltage data of the first memory and a second voltage data provided by an outside circuit and determining the second gray level that the pixel will display.

29 Claims, 2 Drawing Sheets

DRIVING DEVICE AND ITS DRIVING METHOD OF LIQUID CRYSTAL DISPLAY

BACKGROUND OF THE INVENTION

1. Field of the Invention

The present invention relates in general to a driving device and its driving method for a liquid crystal display (LCD) panel. In particular, the present invention relates to a driving circuit and a driving method for rapidly switching the gray levels of a pixel.

2. Description of the Related Art

While there are several types of liquid crystal displays (LCDs), all LCDs operate on the same general principle. A liquid crystal material is placed in a sealed but light transmissive chamber and light transmissive electrodes are placed above and below the liquid crystal material. One type of LCD utilizes twisted nematic liquid crystals, when sufficient electric potential is applied between the electrodes, the liquid crystal molecules change their alignment. The change in alignment alters the polarization state of light passing through the liquid crystal material. The chamber or cell essentially acts as a light shutter or valve, letting a maximum, minimum or some intermediate level of light go through. These levels of light transmittance are called gray levels.

A matrix LCD structure is normally utilized for complex displays. A large number of very small independent regions of liquid crystal material are positioned in a plane. Each of these regions is generally called a picture element or pixel. These pixels are usually arranged in rows and columns forming a matrix. Corresponding numbers of column and row electrodes are correlated with the rows and columns of pixels. An electric potential, also called a driving force, can therefore be applied to any pixel by selection of appropriate row and column electrodes, then a desired graphic can be generated.

The amplitude of a driving force for a pixel depends solely on the gray level that the pixel is going to present. FIG. 1 is a relationship diagram between the light transmittance of a liquid crystal material and the driving voltage. Digitized by 4 bits, for example, the light transmittance is represented by 16 gray levels, $G_{on}$ to $G_{off}$. The oblique line in FIG. 1, enables determination of the driving forces, $V_{on}$ to $V_{off}$, for driving the liquid crystal material to respectively display the gray levels $G_{on}$ to $G_{off}$ under a static condition. The conventional method for driving a pixel is to provide a driving force without consideration of dynamic switching. That is, if a pixel driver consecutively receives signals of gray level in a sequence of [$G_2$, $G_{on}$, $G_4$, $G_5$], for example, it consecutively provides the respective static driving voltages in a sequence of [$V_2$, $V_{on}$, $V_4$, $V_5$] to the pixel.

However, in real situation, the pixel does not necessarily have the gray level corresponding to the driving voltage shown in FIG. 1, particularly when the driving voltage of the pixel changes in a narrow range of variation. In fact, the smaller the difference in the driving voltage is, the poorer the response rate of the pixel is. In other words, the gray level switching between all-black and all-white is faster than the switching between intermediate levels. Thus, the pixel is not able to display the current gray level.

SUMMARY OF THE INVENTION

The object of the display invention is to provide a driving circuit and its method for driving the pixels in a display by comparing the display driving voltage with the next driving voltage of the pixel, then obtain a new driving voltage from a look-up table or perform an algorithm according to the present and next driving voltages to increase the response speed of the pixel.

To achieve the above-mentioned object, the present invention provides a driving device for driving pixels of a display from a first gray level to a second gray level. The first memory stores a first voltage data making the pixel display the first gray level. The second memory stores a driving voltage table recording dynamic driving voltages respectively corresponding to predetermined gray level switching. The controller uses the dynamic driving voltage to drive the pixel. The dynamic driving voltage is selected from the driving voltage table according to the first voltage data of the first memory and second voltage data provided by an external circuit and making the pixel display the second gray level.

In addition, the present invention provides a driving method for driving pixels of a display from a first gray level to a second gray level. The first memory is provided for storing a driving voltage table recording static driving voltages when the gray level of the pixels is fixed and dynamic driving voltages when the gray level of the pixel has changed. The second memory is provided for storing a first driving voltage when the pixel displays the first gray level. A pixel driving voltage is selected from the driving voltage table according to the first driving voltage and a second driving voltage which causes the pixel to display the second gray level and to drive the pixel.

BRIEF DESCRIPTION OF THE DRAWINGS

The display invention will become more fully understood from the detailed description given hereinbelow and the accompanying drawings, given by way of illustration only and thus not intended to be limitative of the present invention.

DETAILED DESCRIPTION OF THE INVENTION

Figure 2:
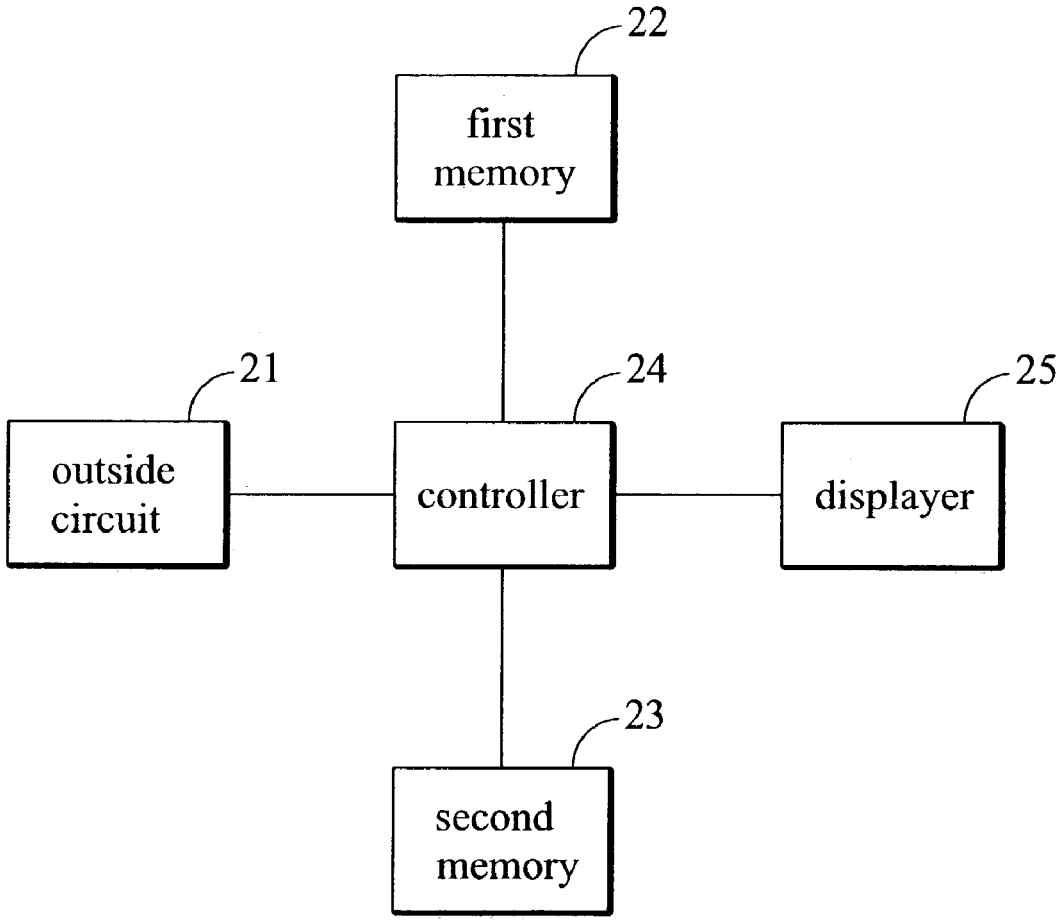
FIG. 2 shows the block diagram of the LCD driving device according to the embodiment of the present invention.

FIG. 2 shows the block diagram of the LCD driving device according to an embodiment of the present invention. The LCD driving device according to the embodiment of the present invention drives the pixels of the display 25 from a first gray level to a second gray level.

The first memory 22 stores the first voltage data making the pixel display a first gray level. The voltage data records the information of the voltage provided to the pixel when the pixel displays the first gray level. The voltage value is referred to FIG. 1.

Figure 1:
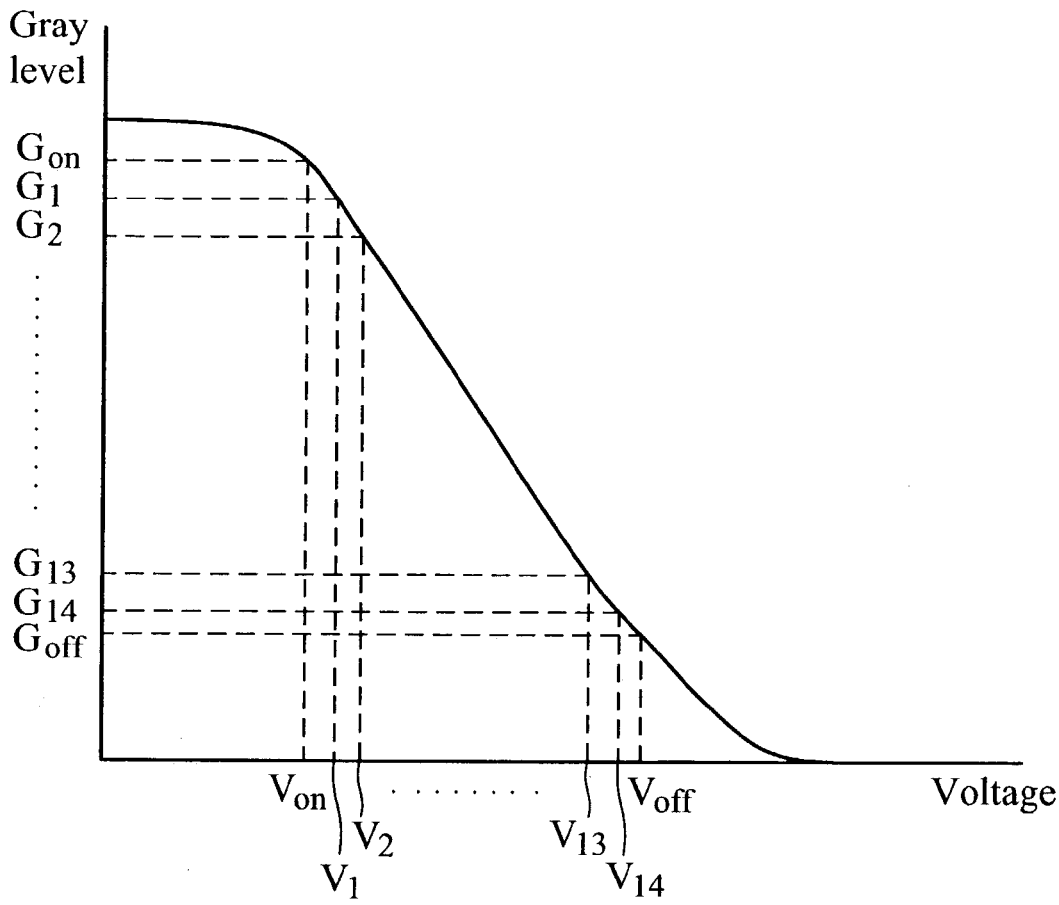
FIG. 1 ( PRIOR ART )
FIG. 1 is a relationship diagram between the light transmittance of a liquid crystal material and the driving voltage.

The second memory 23 stores a driving voltage table recording static driving voltages when the gray level of the pixel is fixed and dynamic driving voltages when the gray level of the pixel is changed. In addition, the driving voltage table can be built by experiments, simulations and history records. The driving voltage value of the conventional driving circuit provided to the pixel is set between $V_{on}$ and $V_{off}$, which is the boundary of the static driving voltages. In FIG. 1, $V_{on}$ and $V_{off}$ make the pixel display the highest light transmittance (brightest) and the lowest transmittance (darkest), respectively. The range of the dynamic driving voltages is greater than the range of static driving voltage. In addition, the highest dynamic driving voltage is the maximum voltage value that the pixel can sustain. That is, the range of the dynamic driving voltages is greater than the boundary between $V_{on}$ and $V_{off}$. As mentioned above, the time required to switch the gray level of the pixel reduced when the voltage provided to the pixel is increased. An appropriate dynamic driving voltage is obtained through experimentation to ensure that the pixel reaches the predetermined gray level more rapidly. In addition, the excessive charging or discharging of the pixel is also avoided. Similarly, the second voltage data is also shown in FIG. 1, thus, the dynamic driving voltages of switching different gray levels are obtained.

The controller 24 can be a digital signal processor, addressing circuit or multiplexor. The controller 24 receives the second voltage data provided by the external circuit 21 determining the second gray level which the pixel will display and the first voltage data from the first memory 22 and obtains a pixel driving voltage from the driving voltage table stored in the second memory 23 to drive the pixel of the display 25 according to the first voltage data and the second voltage data. Or, the controller 24 obtains the correction value according to the first and second driving voltages from the driving voltage correction table, and corrects the second driving voltage by the correction value to generate a dynamic pixel driving voltage to drive the pixel of the display 25. Here, the correction value is not zero when the first gray level and the second gray level are different. On the contrary, the correction value is zero when the first gray level and the second gray level are the same. Thus, the dynamic pixel driving voltage is the second voltage plus the correction value when the first driving voltage is lower than the second driving voltage. The dynamic pixel driving voltage is the second voltage minus the correction value when the first driving voltage is higher than the second driving voltage.

In addition, the controller 24 replaces the first voltage data stored in the first memory 22 by the second voltage data after providing the second voltage data to the pixel. Here, the difference between the corrected driving voltage and the first voltage data is greater than the difference between the second voltage data and the first voltage data. Thus, the switching speed of the gray level of the pixel is faster by increasing the voltage difference between the corrected driving voltage and the first voltage data.

In addition, the controller 24 further processes the driving voltage from low bit data to high bit data according to the driving voltage correction table. In the embodiment of the display invention, the external circuit 21 provides 6-bit voltage data to the controller 24 to display a 6-bit image. The controller 24, however, transforms the 6-bit voltage data to higher-bit data, such as, 7-bit voltage data. The higher-bit voltage data more accurately represents the voltage level. Thus, the pixel is driven by a more appropriate voltage to decrease the switching time of the gray levels.

The foregoing description of the preferred embodiments of this invention has been presented for purposes of illustration and description. Obvious modifications or variations are possible in light of the above teaching. The embodiments were chosen and described to provide the best illustration of the principles of this invention and its practical application to thereby enable those skilled in the art to utilize the invention in various embodiments and with various modifications as are suited to the particular use contemplated. All such modifications and variations are within the scope of the present invention as determined by the appended claims when interpreted in accordance with the breadth to which they are fairly, legally, and equitably entitled.

What is claimed is:

1. A driving device for driving pixels of a display from a first gray level to a second gray level, comprising:

a first memory for storing a first voltage data making a pixel display the first gray level;

a second memory for storing a driving voltage table recording dynamic driving voltages corresponding to predetermined gray level switching, respectively; and a controller for driving the pixel using the dynamic driving voltages, wherein the dynamic driving voltages are selected from the driving voltage table according to the first voltage data of the first memory and a second voltage data provided by an external circuit determining the second gray level that the pixel will display;

wherein the pixel displays a highest light transmittance when the first voltage data equals to a $V_{on}$ voltage and the pixel displays a lowest light transmittance when the first voltage data equals to a $V_{off}$ voltage;

wherein the range between the highest and the lowest dynamic driving voltages is greater than the range between the $V_{on}$ voltage and the $V_{off}$ voltage.

2. The driving device claimed in claim 1, wherein the controller replaces the first voltage data stored in the first memory by the second voltage data.

3. The driving device claimed in claim 2, wherein the difference between the dynamic driving voltage and the first voltage data is higher than the difference between the first voltage data and the second voltage data.

4. The driving device claimed in claim 3, wherein the driving voltage table is built by experiments, simulations or history records.

5. The driving device as claimed in claim 4, wherein the voltage range of the first and second voltage data is set between the voltage data of darkest and brightest pixels.

6. A driving device for driving pixels of a display from a first gray level to a second gray level, comprising:

a first memory for storing a driving voltage table recording static driving voltages when a gray level of a pixel is fixed and dynamic driving voltages when the gray level of the pixel has changed;

a second memory for storing a first driving voltage when the pixel displays the first gray level; and a controller for driving the pixel using the dynamic driving voltages, wherein the dynamic driving voltages are selected from the driving voltage table according to the first driving voltage and the second driving voltage, provided by an external circuit, determining the second gray level that the pixel will display;

wherein the pixel displays a highest light transmittance when the first driving voltage equals to a $V_{on}$ voltage and the pixel displays a lowest light transmittance when the first driving voltage equals to a $V_{off}$ voltage;

wherein the range between the highest and the lowest dynamic driving voltages is greater than the range between the $V_{on}$ voltage and the $V_{off}$ voltage.

7. The driving device as claimed in claim 6, wherein the controller replaces the first driving voltage stored in the second memory with the second driving voltage.

8. The driving device as claimed in claim 6, wherein the difference between the dynamic driving voltage and the first driving voltage is higher than the difference between the first driving voltage and the second driving voltage when the first gray level and the second gray level are different.

9. The driving device as claimed in claim 6, wherein the driving voltage table is built by experiments, simulations or history records.

10. A driving device for driving pixels of a display from a first gray level to a second gray level, comprising:

a first memory for storing a driving voltage correction table recording correction values of driving voltages when a pixel changes from the first gray level to the second gray level;

a second memory for storing a first driving voltage when the pixel displays the first gray level; and a controller for obtaining the correction value according to a second driving voltage making the pixel display the second gray level and the first driving voltage from the driving voltage correction table, and correcting the second driving voltage by the correction value to generate a pixel driving voltage for driving the pixel;

wherein the pixel displays a highest light transmittance when the first driving voltage equals to a $V_{on}$ voltage and the pixel displays a lowest light transmittance when the first driving voltage equals to a $V_{off}$ voltage;

wherein the range between the highest and the lowest corrected second driving voltages is greater than a difference range between the $V_{on}$ voltage and the $V_{off}$ voltage.

11. The driving device as claimed in claim 10, wherein the controller replaces the first driving voltage stored in the second memory with the second driving voltage.

12. The driving device as claimed in claim 10, wherein the correction value is not zero when the first gray level and the second gray level are different.

13. The driving device as claimed in claim 12, wherein the correction value is zero when the first gray level and the second gray level are the same.

14. The driving device as claimed in claim 12, wherein the value of the pixel driving voltage is the second voltage plus the correction value.

15. The driving device as claimed in claim 12, wherein the value of the pixel driving voltage is the second voltage minus the correction value.

16. The driving device as claimed in claim 10, wherein the controller further process as the driving voltage from low bit data to high bit data according to the driving voltage correction table.

17. A driving method for driving pixels of a display from a first gray level to a second gray level, comprising the following steps:

providing a first memory for storing a driving voltage table recording static driving voltages when a gray level of a pixel is fixed and dynamic driving voltages when the gray level of the pixel has changed;

providing a second memory for storing a first driving voltage when the pixel displays the first gray level; and selecting a pixel driving voltage from the driving voltage table according to the first driving voltage and a second driving voltage making the pixel display the second gray level to drive the pixel;

wherein the pixel displays a highest light transmittance when the first driving voltage equals to a $V_{on}$ voltage and the pixel displays a lowest light transmittance when the first driving voltage equals to a $V_{off}$ voltage;

wherein the range between the highest and the lowest dynamic driving voltages is greater than the range between the $V_{on}$ voltage and the $V_{off}$ voltage.

18. The driving method as claimed in claim 17, further comprising the step of replacing the first driving voltage stored in the second memory with the second driving voltage.

19. The driving method as claimed in claim 17, wherein the difference between the pixel driving voltage and the first driving voltage is higher than the difference between the first driving voltage and the second driving voltage when the first gray level and the second gray level are different.

20. The driving method as claimed in claim 19, wherein the pixel driving voltage is equal to the second driving voltage when the first gray level is the same with the second gray level.

21. The driving method as claimed in claim 17, wherein the second driving voltage is transformed to the pixel driving voltage from low-bit to high-bit.

22. A driving method for driving pixels of a display from a first gray level to a second gray level, comprising the following steps:

providing a first memory for storing a driving voltage correction table recording correction value of driving voltages when the pixel changes from the first gray level to the second gray level;

providing a second memory for storing a first driving voltage when the pixel displays the first gray level;

obtaining the correction value according to a second driving voltage making the pixel display the second gray level and the first driving voltage from the driving voltage correction table; and generating a pixel driving voltage by correcting the second driving voltage with the correction value to drive the pixel;

wherein the pixel displays a highest light transmittance when the first driving voltage equals to a $V_{on}$ voltage and the pixel displays a lowest light transmittance when the first driving voltage equals to a $V_{off}$ voltage;

wherein the range between the highest and lowest pixel driving voltages is greater than the range between the $V_{on}$ voltage and the $V_{off}$ voltage.

23. The driving method as claimed in claim 22, further comprising the step of replacing the first driving voltage stored in the second memory by the second driving voltage.

24. The driving method as claimed in claim 22, wherein the correction value is not zero when the first gray level and the second gray level are different and the correction value is zero when the first gray level is equal to the second gray level.

25. The driving method as claimed in claim 22, wherein the value of the pixel driving voltage is the second voltage plus the correction value.

26. The driving method as claimed in claim 22, wherein the value of the pixel driving voltage is the second voltage minus the correction value.

27. The driving device as claimed in claim 22, further comprising the steps of processing the driving voltage from low bit data to high bit data according to the driving voltage correction table.

28. A driving method for driving pixels of a display from a first gray level to a second gray level, comprising the following steps:

receiving a first driving voltage determining the first gray level that the pixel will display;

receiving a second driving voltage of making the pixel display the second gray level; and driving the pixel by a pixel driving voltage selected from a driving voltage table according to the first driving voltage and the second driving voltage, wherein the driving voltage table records static driving voltages when the gray level of the pixel is fixed and dynamic driving voltage when the gray level of the pixel has changed;

wherein the pixel displays a highest light transmittance when the first driving voltage equals to a $V_{on}$ voltage and the pixel displays a lowest light transmittance when the first driving voltage equals to a $V_{off}$ voltage;

wherein the range between the highest and the lowest dynamic driving voltages is greater than the range between the $V_{on}$ voltage and the $V_{off}$ voltage.

29. A driving method for driving pixels of a display from a first gray level to a second gray level, comprising the following steps:

receiving a first driving voltage determining the first gray level that the pixel will display;

receiving a second driving voltage determining the second gray level that the pixel will display; and obtaining a correction value of driving voltages from a driving voltage correction table according to the first driving voltage and the second driving voltage, wherein the driving voltage correction table stores the correction value of the driving voltage when the pixel changes from the first gray level to the second gray level; and correcting the second driving voltage by the correction value to drive the pixel;

wherein the pixel displays a highest light transmittance when the first driving voltage equals to a $V_{on}$ voltage and the pixel displays a lowest light transmittance when the first driving voltage equals to a $V_{off}$ voltage;

wherein the range between the highest and the lowest corrected driving voltages is greater than the range between the $V_{on}$ voltage and the $V_{off}$ voltage.

* * * * *